US006937260B2

(12) United States Patent
Williams et al.

(10) Patent No.: US 6,937,260 B2
(45) Date of Patent: Aug. 30, 2005

(54) ALIGNMENT MECHANISM FOR DIRECT MARKING PRINTHEADS AND A METHOD FOR ALIGNING PRINTHEADS IN A PRINTER

(75) Inventors: Antonio L. Williams, Lake Oswego, OR (US); Clifford L. George, Geneseo, NY (US)

(73) Assignee: Xerox Corporation, Stamford, CT (US)

( * ) Notice: Subject to any disclaimer, the term of this patent is extended or adjusted under 35 U.S.C. 154(b) by 56 days.

(21) Appl. No.: 10/743,098

(22) Filed: Dec. 23, 2003

(65) Prior Publication Data

US 2005/0134672 A1 Jun. 23, 2005

(51) Int. Cl.[7] ..... B41J 25/00; B41J 29/00

(52) U.S. Cl. ..... 347/198; 400/120.17

(58) Field of Search ..... 347/197, 198; 400/120.16, 120.17

(56) References Cited

U.S. PATENT DOCUMENTS 5,138,336 A * 8/1992 Goto ..... 347/198
6,068,415 A 5/2000 Smolenski
6,298,783 B1 10/2001 O'Mera et al.

* cited by examiner

*Primary Examiner*—Huan Tran
(74) *Attorney, Agent, or Firm*—Oliff & Berridge, PLC; Eugene O. Palazzo, Esq.

(57) ABSTRACT

A device and method for the alignment, in up to six degrees of freedom, of printheads in a printer is disclosed. The device has a support, wherein the printhead is secured to a substantially center location of the support. The device further has a fixed plate biased against the support by plurality of first screws extending substantially in a Z direction, a plurality of a second screws extending substantially in a Y direction, and a third screw extending substantially in an X direction. The fixed plate, and thus the printhead, may be translated in each of the X, Y and Z directions and may be rotated about each of the X, Y, and Z axes by manipulation of the screws to achieve possible alignment in all six degrees of freedom.

20 Claims, 7 Drawing Sheets

ALIGNMENT MECHANISM FOR DIRECT MARKING PRINTHEADS AND A METHOD FOR ALIGNING PRINTHEADS IN A PRINTER

BACKGROUND OF THE INVENTION

1. Field of Invention

This invention is directed to direct marking systems that utilize multiple staggered printheads in order to achieve full width printing per pass. More specifically, this invention is directed to a device and method for the alignment, in six degrees of freedom or less, of multiple printheads in a printer by providing adjustments in up to all six degrees of freedom for each printhead.

2. Description of Related Art

Misalignment of printheads may be due to, for example, poor manufacturing tolerances, thermal expansion of the printhead and associated parts of the printer, vibration of the printhead, or the like. Thus, aligning the printheads with sufficient accuracy to allow high image quality is desired.

Devices for alignment of printheads in a printer are known. For example, U.S. Pat. No. 6,068,415 to Smolenski discloses a printhead that is spring loaded, permitting it to float in both the vertical and horizontal directions. Smolenski also discloses placing the printhead on a comparatively short and rigid pivoting arm.

U.S. Pat. No. 6,298,783 to O'Mera at al. discloses an alignment device for mounting an alignable part, such as a thermal printhead, on a support frame. The printhead is adjustable on the support frame relative to a reference plane about a pivot axis on the support frame and also laterally of the reference plane.

Known mechanisms for alignment of printheads are limited in the number of degrees of translation and rotation of the printhead that can be independently adjusted. This is not suitable since misalignment may occur in any of the six degrees of freedom (translation and rotation). Some existing technologies use an additional alignment mechanism for each increment in degree of freedom. However, this leads to a larger footprint area of the alignment mechanisms, more parts, and thus more thermal expansion and vibration, further leading to misalignment of the printhead.

SUMMARY OF THE INVENTION

There is a need for an alignment mechanism for printheads in all six degrees of freedom or less, with sufficient accuracy to allow high image quality.

There is a need for an alignment mechanism for printheads that may align a plurality of printheads with respect to each other and with respect to the print medium.

There is a need for an alignment mechanism that can align multiple staggered printheads.

There is a need for a more compact alignment mechanism.

The above and other advantages are achieved by various embodiments of the invention.

The alignment device of the present invention consists of plates that are spring loaded together. Adjustment screws are used to move the plates relative to each other, thereby allowing the printhead to be adjusted independently in any of the six degrees of freedom.

In exemplary embodiments, a printhead may be aligned in up to six degrees of freedom.

In exemplary embodiments, the thermal expansion of the printhead may be reduced by minimizing the number of required alignment mechanisms for a multiple staggered printhead assembly for a printer.

In exemplary embodiments, the vibration of the printhead may be reduced by a more compact alignment mechanism that may be more centrally located with respect to the printhead.

In exemplary embodiments, increased life of the printer can be achieved by the reduction in vibration and thermal expansion of the different parts of the printer.

In exemplary embodiments, improved print quality may be achieved by an improved alignment mechanism for printheads.

DETAILED DESCRIPTION OF PREFERRED EMBODIMENTS

Six degrees of freedom, as used herein, refers to each of the degrees of translation and rotation with respect to the X, Y, and Z axes. That is, the six degrees of freedom comprise (1) translation in the X direction, (2) translation in the Y direction, (3) translation in the Z direction, (4) rotation about the X axis, (5) rotation about the Y axis and (6) rotation about the Z axis.

Figure 1:
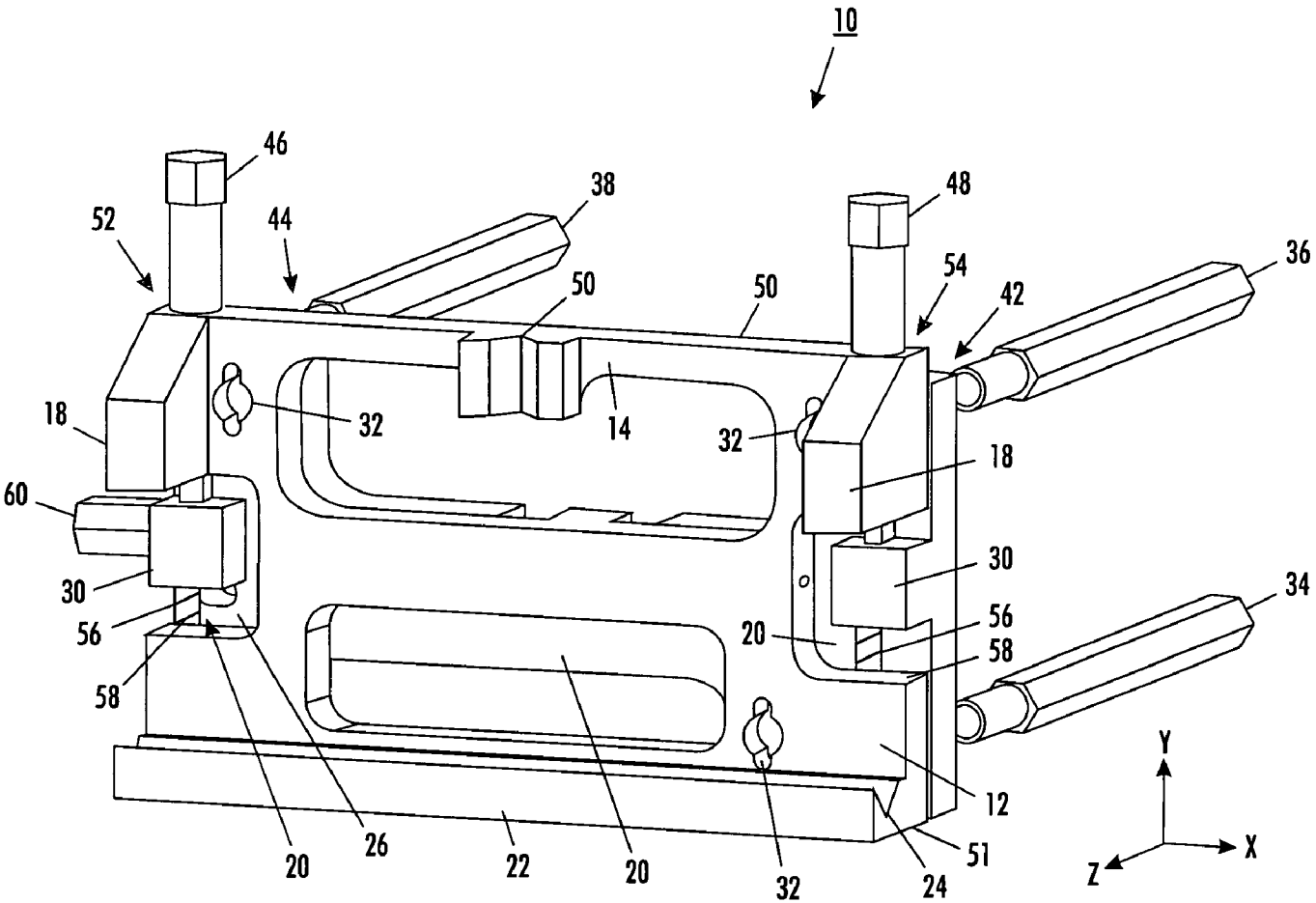
FIG. 1 illustrates a front view of an alignment mechanism for printheads.
Figure 2:
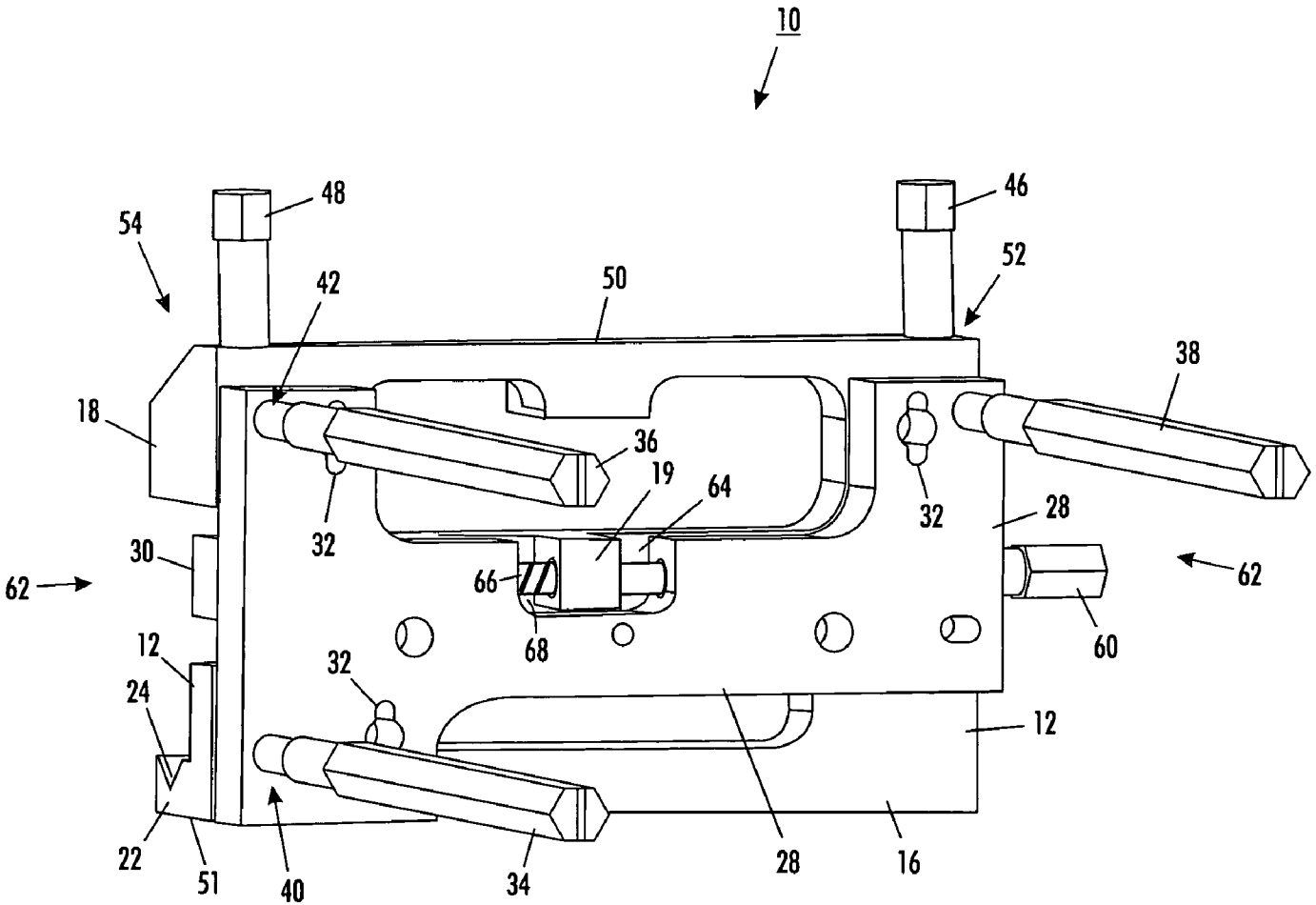
FIG. 2 illustrates a rear view of an alignment mechanism for printheads.

Referring to FIGS. 1 and 2, an alignment mechanism 10 of the present invention is illustrated. The alignment mechanism contains a plate 12 having a front surface 14 and a back surface 16. A plurality of protrusions 18 are located on the front surface 14 of the plate 12. Two of the plurality of protrusions 18 are each located on opposite sides of the plate 12 and extend from the front surface 14 of the plate 12. Openings 20 in the plate 12 are located at least under each of the two protrusions 18. The openings 20 allow for a reduced total mass of the alignment mechanism and may be designed to accommodate different parts of the alignment mechanism and/or the printing device in which the alignment mechanism is located.

The plate 12 has a protruding lip 22 on which a printhead (not shown) can be secured. The lip 22 may preferably have a channel or groove 24 on which the printhead may be secured to the plate 12 in a substantially central location of the alignment mechanism 10. Thus, by aligning the plate 12, the printhead secured thereon may be aligned in six different degrees of freedom.

The back surface 16 of the plate 12 is biased against a face 26 of a fixed plate 28 in the Z direction. Projections 30 on the face 26 of the fixed plate 28 extend through or into each of the openings 20 under the two protrusions 18 of the plate 12 when the plate 12 is biased against the fixed plate 28.

The plate 12 is biased against the face 26 of the fixed plate 28 via springs 32 connected between the plate 12 and the fixed plate 28. Three independent adjustment screws 34, 36 and 38 are secured to the fixed plate 28 via threaded holes (not shown). The adjustment screws 34, 36 and 38 extend between the fixed plate 28 and the plate 12. The springs 32 provide a load that applies a force to the plate 12 in a direction counter to the adjustment screws 34, 36 and 38.

Rotation of the adjustment screws 34, 36 and 38 results in translation of the plate in the Z direction at adjustment points 40, 42 and 44, respectively. To adjust the a printhead uniformly in the Z direction, all three adjustment screws 34, 36 and 38 must be rotated an equal amount in the same direction (i.e., either the clockwise or counter-clockwise direction) thereby adjusting the plate 12 on which the printhead is attached.

The adjustment screws 34, 36 and 38 preferably maybe located at right angles with respect to each other and within the same vertical plane. Each of the adjustment screws 34, 36 and 38 are also spaced apart to the extent sufficient to permit rotation upon adjustment (i.e., rotation of the screw), thereby allowing independent rotation of the plate 12 (and thus the printhead) about an X and/or Y axis. More specifically, the adjustment screws 36 and 38 are preferably each located adjacent and inside two separate protrusions 18 and within the same horizontal plane, while the adjustment screw 34 is located at a right angle from the adjustment screw 36 and in the same vertical plane as the adjustment screw 36. Thus, for example, to rotate the printhead about the X axis, adjustment screws 36 and 38 would be uniformly rotated while the adjustment screw 34 remains fixed. To rotate the printhead about the Y axis, the adjustment screw 38 would be rotated while the adjustment screws 34 and 36 remain fixed.

Alignment of the printhead in the Y direction is accomplished via two independent adjustment screws 46 and 48. The adjustment screws 46 and 48 preferably may each be located at right angles with respect to each of adjustment screws 34, 36, and 38. The adjustment screws 46 and 48 are secured to a top surface 50 of the plate 12 or to a bottom surface 51 of the plate 12 via threaded holes (not shown) on opposite ends 52 and 54 of the plate 12. Each of the adjustment screws 46 and 48 extend through the plate 12 into each of the openings 20 under the two protrusions 18 of the plate 12, and into the projections 30 on the face 26 of the fixed plate 28, when the plate 12 is biased against the fixed plate 28. Two compression springs 56 bias a bottom 58 of each of the openings 20 under the two protrusions 18 against a tip (not shown) of each of the adjustment screws 46 and 48.

Rotation of the adjustment screws 46 and 48 results in translation of the plate 12 in the Y direction. To adjust the plate 12 uniformly in the Y direction, both of the adjustment screws 46 and 48 must be rotated an equal amount and in the same direction while keeping the adjustment screws 34, 36 and 38 fixed.

Rotation of the adjustment screws 46 and 48 also results in rotation of the plate 12 about the Z axis. To rotate the plate 12 about the Z axis, either of the adjustment screws 46 or 48 may be rotated while keeping the adjustment screws 34, 36 and 38 fixed.

Alignment of the printhead in the X direction is accomplished via an adjustment screw 60. The adjustment screw 60 preferably may be located at a right angle with respect to each of the adjustment screws 34, 36, 38, 46 and 48. The adjustment screw 60 is secured to a side 62 of the fixed plate 28 via a threaded hole (not shown) in the fixed plate 28. The adjustment screw 60 extends through the fixed plate 28 into a window 64 located in the fixed plate 28 and into or through another protrusion 19 extending from the back surface 16 of the plate 12. The plate 12 is biased against the adjustment screw 60 by another compression spring 66 extending from a wall 68 of the window 64 to a tip (not shown) of the adjustment screw 60.

Adjustment in the X direction is accomplished by rotation of the adjustment screw 60.

Although the adjustment screws 34, 36, 38, 46, 48 and 60 as described herein allow for translation and/or rotation of the printhead, each of the adjustments screws 34, 36, 38, 46, 48 and 60 may also be designed to remain fixed. Accordingly, any of the adjustment screws 34, 36, 38, 46, 48 and 60 may be, for example, a rod or other fixed object that remains fixed.

Further, it is envisioned that the alignment mechanism may be constructed with fewer than the six adjustment screws 34, 36, 38, 46, 48 and 60 thereby providing translation and rotation in less than all six degrees of freedom. Alternatively, the six adjustment screws 34, 36, 38, 46, 48 and 60 or less than the six adjustment screws may be located at varying angles and directions with respect to each other without exceeding the intended scope of this invention.

The alignment mechanism 10 as described with reference to FIGS. 1 and 2 can be used in a printer within a direct marking print engine where the adjustment of the printhead is required. Further, more than one alignment mechanism 10 may be incorporated into the printer to accommodate more than one printhead.

Figure 3:
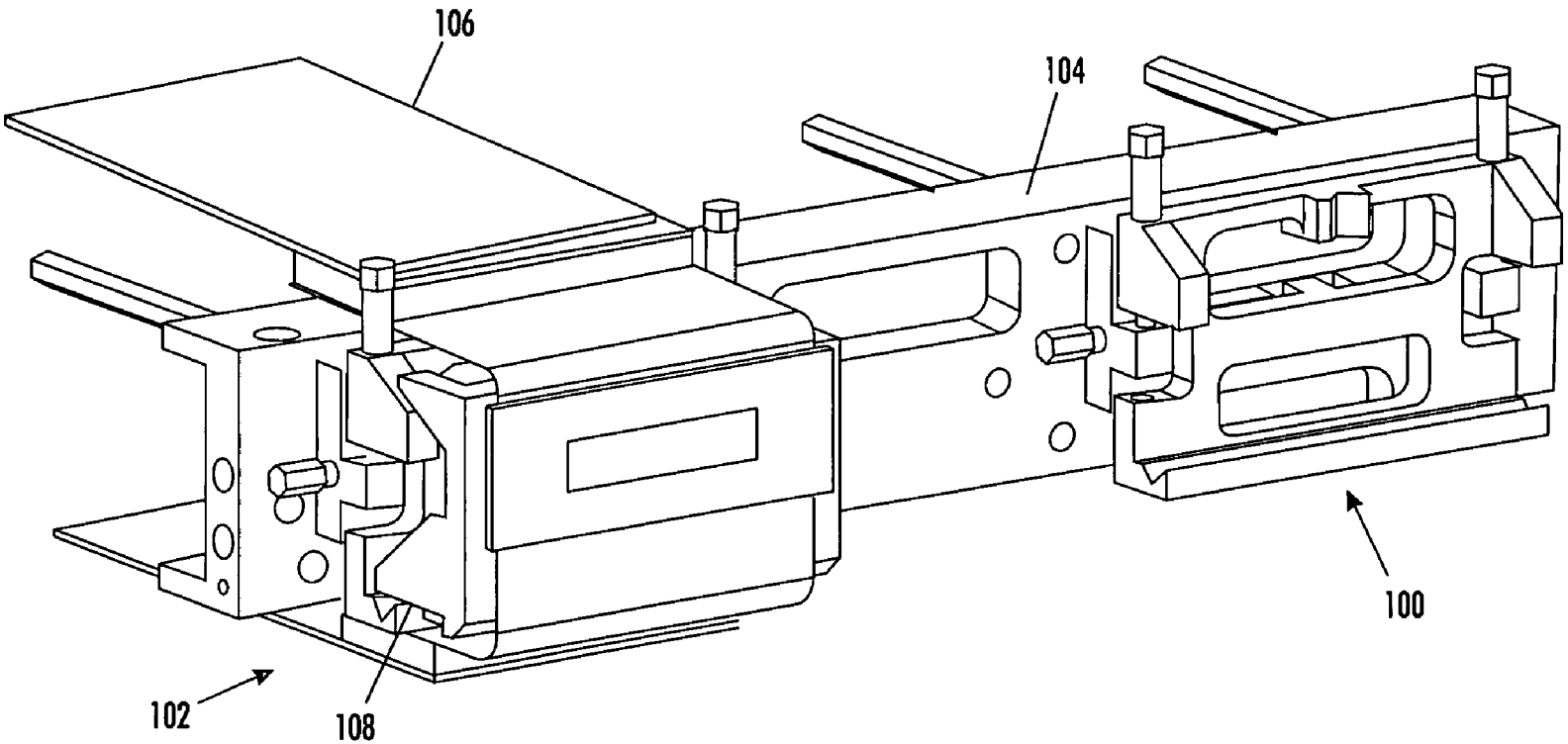
FIG. 3 illustrates multiple alignment mechanisms with a printhead for a single printer.
Figure 4:
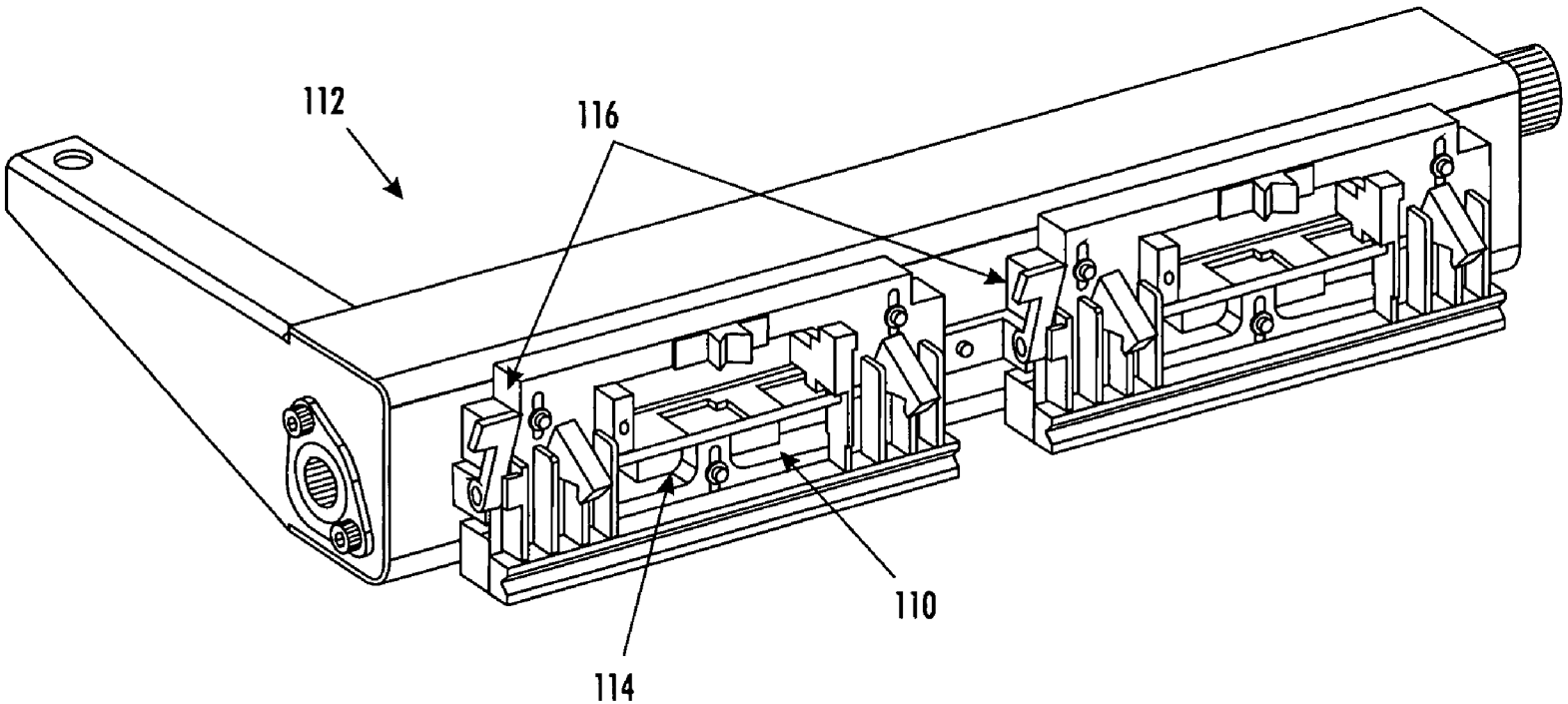
FIG. 4 illustrates a front view of an embodiment of multiple alignment mechanisms with a printhead for a single printer.
Figure 5:
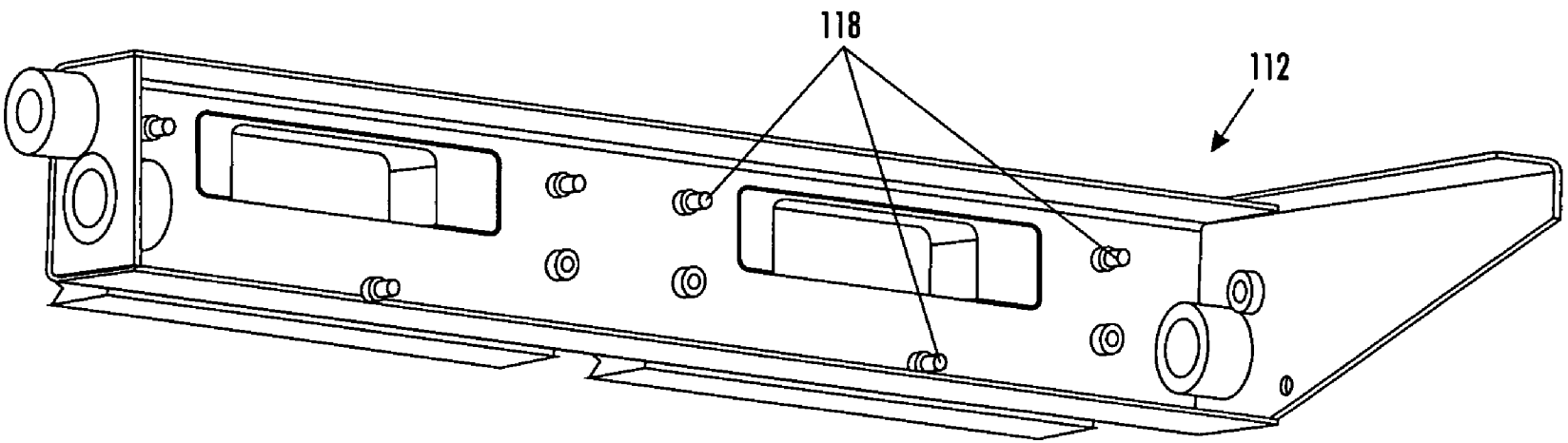
FIG. 5 illustrates a rear view of an embodiment of multiple alignment mechanisms with a printhead for a single printer.
Figure 6:
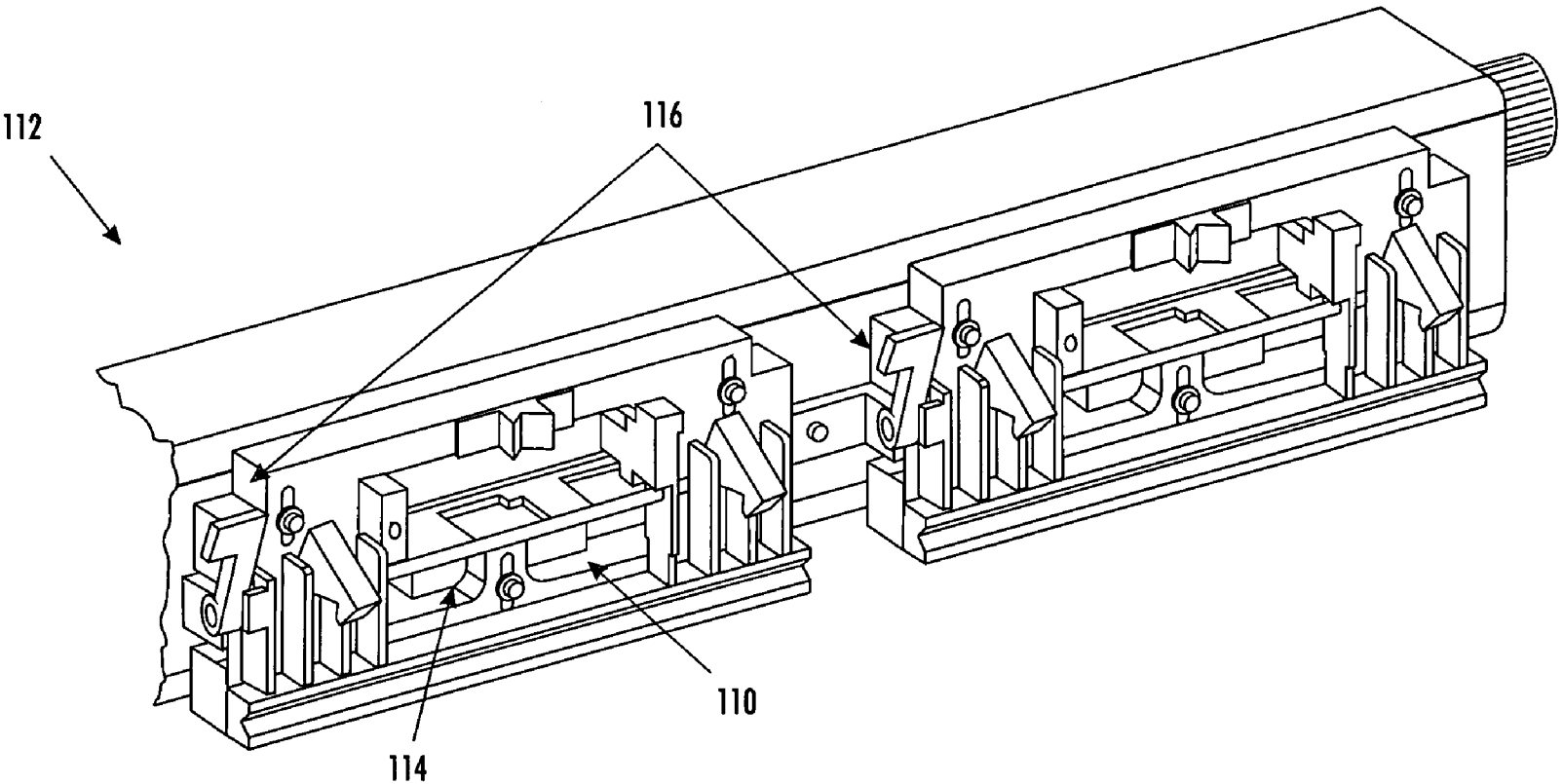
FIG. 6 illustrates a front view of an embodiment of multiple alignment mechanisms with a printhead for a single printer.
Figure 7:
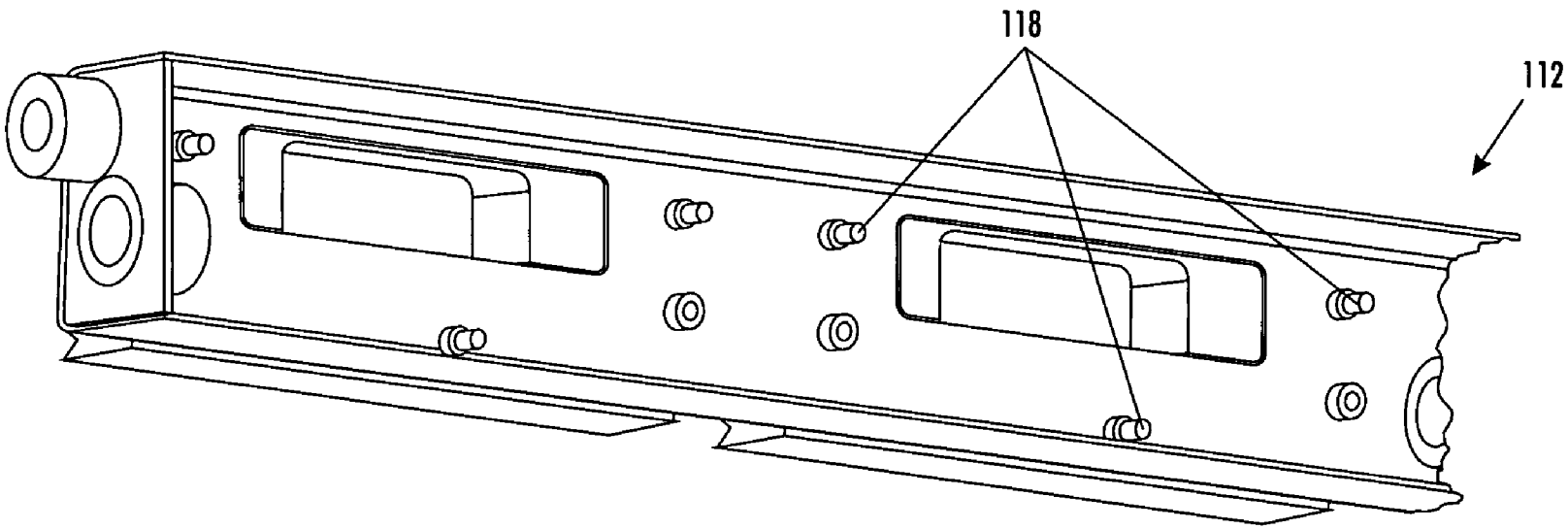
FIG. 7 illustrates a rear view of an embodiment of multiple alignment mechanisms with a printhead for a single printer.

FIGS. 3–5 illustrate more than one alignment mechanism 10 mounted to different parts of the printer. FIG. 3 illustrates a first alignment mechanism 100 and a second alignment mechanism 102 mounted on a frame 104. A printhead assembly 106 is shown with a printhead 108 attached to the second alignment mechanism 102 as described above. Here, the first alignment mechanism 100 and the second alignment mechanism 102 allow for relative alignment of multiple printheads in the same printer.

In another embodiment, different parts of a printer may be used as the fixing plate for a plurality of alignment mechanisms. Referring to FIGS. 4–7, a plate 110 (as described above with respect to plate 12 of the alignment mechanism 10), may be biased against a frame 112 (as described above with respect to the fixing plate 28 of the alignment mechanism 10). The frame 112 may be sheet metal, a casting, or any fixed object in an image forming device. Adjustment screws 114, 116 and 118 may allow for adjustment of a printhead in six degrees of freedom as described above with respect to the adjustment screws 60; 46 and 48; and 34, 36 and 38, respectively.

It is envisioned that the alignment mechanism of the present invention may be used to manually adjust printheads or may be used in conjunction with a motor for automatic adjustment of the printheads without human intervention.

Further, the alignment mechanism of the present invention allows for mounting of the printhead nearer to the center of mass of the alignment mechanism, thereby reducing vibration of the printhead and alignment mechanism.

Still further, the alignment mechanism allows for a reduced number of parts required to align the printhead in the six different degrees of freedom, thereby reducing thermal expansion. By reducing thermal expansion and vibration of the different parts, the life of the parts of the printers may be increased and required realignment of the printhead decreased.

Further, the alignment mechanism of the present invention allows for improved print quality.

The plate 12 and fixed plate 28 as well as the other parts of the alignment mechanism discussed herein may be of any shape or size and the shape illustrated herein is not intended to limit the embodiments of the invention discussed herein.

It is envisioned that the alignment mechanism for printheads of the present invention may be used in a variety of different environments, such as, for example, with printers, copiers, fax machines, and the like.

While certain exemplary embodiments have been described in detail and shown in the accompanying drawings, those of ordinary skill in the art will recognize that the invention is not limited to the embodiments described and that various modification may be made to the illustrated and other embodiments of the invention described above, without departing from the broad inventive scope thereof. It will be understood, therefore, that the invention is not limited to the particular embodiments or arrangements disclosed, but is rather intended to cover any changes, adaptations or modifications which are within the scope and spirit of the invention as defined by the appended claims.

What is claimed is:

1. An alignment mechanism for a printhead in a printer, the alignment mechanism comprising:

a support, wherein the printhead is secured to the support;

a fixed plate biased against the support;

a plurality of first screws or rods extending substantially in a first direction that attach the substrate to the fixed plate;

a plurality of second screws or rods extending substantially in a second direction that attach the substrate to the fixed plate; and a third screw or a rod extending substantially in a third direction that attaches the fixed plate to the support.

2. The alignment mechanism of claim 1, wherein the first direction is a Z direction, the second direction is a Y direction and the third direction is an X direction and wherein each of the X direction, Y direction and Z direction lie at right angles with respect to one another.

3. The alignment mechanism of claim 1 wherein the printhead is secured to a substantially center location of the support.

4. The alignment mechanism of claim 1, wherein rotation of the plurality of first screws, while the plurality of second screws and the third screw remain fixed, results in the support moving substantially in the first direction with respect to the fixed plate.

5. The alignment mechanism of claim 1, wherein rotation of the plurality of second screws, while the plurality of first screws and the third screw remain fixed, results in the support moving substantially in the second direction with respect to the fixed plate.

6. The alignment mechanism of claim 1, wherein rotation of the third screw, while the plurality of the first screws and the plurality of second screws remain fixed, results in the support moving substantially in the third direction with respect to the fixed plate.

7. The alignment mechanism of claim 1, wherein the plurality of first screws are each located at right angles with respect to each other.

8. The alignment mechanism of claim 1, wherein the plurality of first screws are located at right angles with respect to the plurality of second screws and the third screw and wherein the plurality of second screws are located at right angles with respect to the third screw.

9. The alignment mechanism of claim 1, wherein a first of the plurality of first screws is rotated while a remaining of the plurality of the first screws remain fixed results in the support rotating about a first axis or second axis with respect to he fixed plate.

10. The alignment mechanism of claim 9, wherein the first axis is an X axis and the second axis is a Y axis.

11. The alignment mechanism of claim 1, wherein rotation of any one of the plurality of second screws, while the remaining of the plurality of second screws remain fixed, the plurality of first screws remain fixed, and the third screw remains fixed, results in the support rotating about a third axis with respect to the fixed plate.

12. The alignment mechanism of claim 11, wherein the third axis is a Z axis.

13. The alignment mechanism of claim 1 further comprising:

a plurality of openings in the support;

a plurality of openings in the fixed plate;

a plurality of protrusions on the support, wherein at least one of the plurality of protrusions on the support extends into at least one of the openings in the fixed plate; and a plurality of projections on the fixed plate, wherein at least one of the plurality of projections on the fixed plate extends into at least one of the openings in the support.

14. The alignment mechanism of claim 13 further comprising:

a top surface of the fixed plate, wherein the plurality of second screws extend from the top surface of the fixed plate, through the fixed plate and into the at least one of the plurality of projections on the fixed plate in the at least one of the openings in the support.

15. The alignment mechanism of claim 13 further comprising:

a side of the fixed plate, wherein the third screw extends through the side of the fixed plate, into one of the plurality of openings in the fixed plate and into one of the plurality of protrusions of the support.

16. The alignment mechanism of claim 1 further comprising:

a plurality of springs; and a tip associated with each of the a plurality of first screws, the plurality of second screws, and the third screw;

wherein each tip of the plurality of first screws, the plurality of second screws, and the third screw is biased by a respective one of the plurality of springs against the fixed plate or the support.

17. The alignment mechanism of claim 1 further comprising:

a second plate biased against the fixed plate;

a second set of a plurality of first screws extending substantially in the first direction that attach the second plate to the fixed plate;

a second set of a plurality of second screws extending substantially in the second direction that attach the second plate to the fixed plate; and a second third screw extending substantially in the third direction that attaches the second plate to the fixed plate.

18. A method for providing the alignment mechanism of claim 1, the method comprising the steps of:

associating a printhead with the alignment mechanism; and adjusting screws to adjust the printhead in six degrees of freedom including translation of the printhead in the first direction, the second direction and the third direction and rotation of the printhead about a first axis, a second axis and a third axis.

19. The alignment mechanism of claim 1, wherein each of the plurality of first screws, the plurality of second screws and the third screw are adjusted manually or by motor.

20. An image forming device including the alignment mechanism of claim 1.

* * * * *